US011827045B2

(12) United States Patent
Becker

(10) Patent No.: US 11,827,045 B2
(45) Date of Patent: Nov. 28, 2023

(54) MANUFACTURE OF AEROSOL CONTAINERS

(71) Applicant: DS Containers, Inc., Batavia, IL (US)

(72) Inventor: Steve Becker, West Chicago, IL (US)

(73) Assignee: DS Containers, Inc., Batavia, IL (US)

( * ) Notice: Subject to any disclaimer, the term of this patent is extended or adjusted under 35 U.S.C. 154(b) by 232 days.

(21) Appl. No.: 17/331,915

(22) Filed: May 27, 2021

(65) Prior Publication Data

US 2022/0332137 A1 Oct. 20, 2022

Related U.S. Application Data

(60) Provisional application No. 63/175,142, filed on Apr. 15, 2021.

(51) Int. Cl.

| | |
|---|---|
| ***B41M 7/00*** | (2006.01) |
| ***B41F 17/20*** | (2006.01) |
| ***B41J 11/00*** | (2006.01) |

(52) U.S. Cl.

CPC ..... *B41M 7/0045* (2013.01); *B41F 17/20* (2013.01); *B41J 11/00214* (2021.01); *B41M 7/0072* (2013.01); *B41M 2205/40* (2013.01)

(58) Field of Classification Search

CPC .... B41M 7/0081; B41M 1/40; B41M 5/0047; B41J 11/00214; B41J 3/4073; B65C 3/00

See application file for complete search history.

(56) References Cited

U.S. PATENT DOCUMENTS

| | | | | |
|---|---|---|---|---|
| 5,851,610 | A * | 12/1998 | Ristey | B29C 55/143 428/339 |
| 10,739,705 | B2 * | 8/2020 | Stowitts | B41F 17/002 |
| 11,338,593 | B1 * | 5/2022 | Bullington | B41J 3/40733 |
| 2005/0034423 | A1 * | 2/2005 | Sindermann | B65C 9/0062 53/136.1 |
| 2008/0239044 | A1 * | 10/2008 | Yokota | B41J 11/00218 347/102 |
| 2012/0199021 | A1 * | 8/2012 | Till | B41F 17/28 101/36 |
| 2015/0033965 | A1 * | 2/2015 | Knott | B41F 17/00 101/36 |
| 2015/0158304 | A1 * | 6/2015 | Kida | C09D 11/324 347/33 |
| 2016/0167399 | A1 * | 6/2016 | Ohnishi | B41J 11/00214 347/102 |
| 2019/0105906 | A1 * | 4/2019 | Suzuki | B41J 2/1714 |
| 2019/0111709 | A1 * | 4/2019 | Weber | B41J 3/4073 |

* cited by examiner

*Primary Examiner* — John Zimmermann

(74) *Attorney, Agent, or Firm* — Sandberg Phoenix & von Gontard, PC

(57) ABSTRACT

A production line is for aerosol containers (AC) whose exterior surface is printed with inks in a predetermined pattern to form a desired design including both imagery and graphics. The line includes an inking station and a varnish application station through which aerosol containers successively pass. Inks are applied to containers at the inking station and a varnish to the inked exterior of the container at the varnish station. A LED light module (12) installed between the ink station and varnish station emits a light within a predetermined frequency range onto inked containers. The temperature produced by the LED light source is cooler than that of Uv light sources that could be used for the same purpose. The exterior surface of finished containers exhibit no lapping or discolorations and have improved scratch resistance.

10 Claims, 6 Drawing Sheets

MANUFACTURE OF AEROSOL CONTAINERS

REFERENCE TO RELATED APPLICATIONS

This application is based on United States provisional patent application 63/175,142 filed Apr. 15, 2021, the contents of which are incorporated herein by reference.

GOVERNMENT FUNDING

N/A.

BACKGROUND OF THE INVENTION

In the manufacture of aerosol containers or cans, after the containers are formed, they are sequentially routed through a printing station where inks are applied to the exterior of each can using a dry offset printing process. The inks, once applied, need to be cured before a varnish is applied or "laid on" the can to seal the can.

There are two types of varnishes which can be used. One is a water based varnish and the other is a solvent gloss or matte based varnish. Heretofore, aerosol containers have typically not been cured using a light and this has limited the type of varnish which can be used for curing to water based varnishes. Referring to the FIG. 1, it has been found that using a conventional dry offset print process in which ink curing is accomplished without use of a light source often results in containers with unsightly ink discolorations, as indicated by the irregular shaped lap line L on the container shown in the figure. The lap line, for example, results from the overall mechanics of the printing decorator, as well as ink and varnish incompatibilities due to the solvent content, and a short dwell time in ink curing ovens through which containers are routed before varnishing. Other problems with the current process include yellowing over time of a finished container and a lack of container scratch resistance.

The overall result is that using the present process, container manufacturers are limited as to the varnishes they can use, even if there is a demand and a market for containers manufactured using other, specifically, solvent based varnishes.

An improvement to the container manufacturing process would be the use of a light source to affect curing of the ink before a container is varnished as this would now allow solvent based varnishes to be used for curing. One such light source is an ultraviolet (Uv) light source. However, a significant disadvantage of using such a light source is the high intensity light it produces results in high temperatures that impair the curing process, as well as the creation of fumes which now must be exhausted.

However, it has been found that a LED light source, which produces much lower temperatures than a Uv source effects the desired curing without the drawbacks of the Uv source.

SUMMARY OF THE INVENTION

The improved manufacturing process of the present invention now allows containers' exterior surfaces to be printed using an offset dry printing process, but with solvent based varnishes now being usable for curing. Containers made using the improved process now have better scratch and scuff resistance, and significantly less or no yellowing of the finished product. Also, containers exhibit a glossier appearance and no visible lap lines.

The improved process also has the advantage of being able to run matte varnishes, also without the yellowing often encountered with water based varnishes.

The improved process is used in the manufacture of steel or aluminum containers to impart affix a predetermined design including graphics and imagery on an exterior surface of a container.

Overall, there is an improved performance throughout the production line, and the variety of containers exhibiting different finishes is significantly increased which now provides the manufacturer a wider selection of container offerings.

To affect this improved performance, an LED light source allows inks to cure. It has been found that an LED light source, even one continuously running, allows varnishes to cure at much lower temperatures than if a Uv source is used in the manufacturing process. This is because the container temperature is now much lower when the varnish is applied to the container than if the ink was dried using a higher temperature Uv light source.

Other objects and features will be in part apparent and in part pointed out throughout the accompanying description.

BRIEF DESCRIPTION OF THE DRAWINGS

Corresponding reference characters will be used throughout the several figures of the drawings as appropriate.

DETAILED DESCRIPTION

Figure 1:
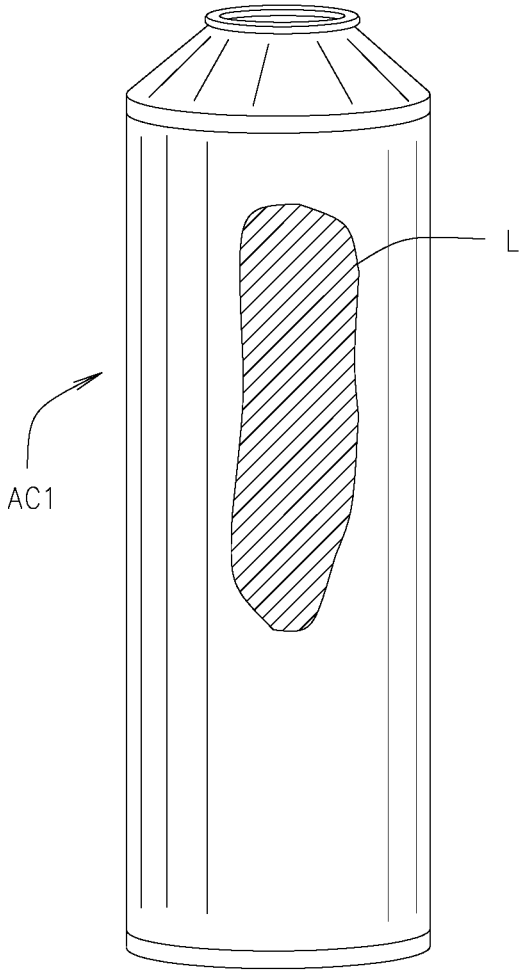
FIG. 1 illustrates an aerosol container in which no light source is used to cure ink applied the container before a varnish is applied with imperfections resulting on the exterior surface of the container.

The following detailed description illustrates the claimed invention by way of example and not by way of limitation. This description will clearly enable one skilled in the art to make and use the claimed invention, and describes several embodiments, adaptations, variations, alternatives and uses of the claimed invention, including what I presently believe is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the illustrations, phraseology and terminology used herein is for the purpose of description and should not be regarded as limiting.

Figure 12:
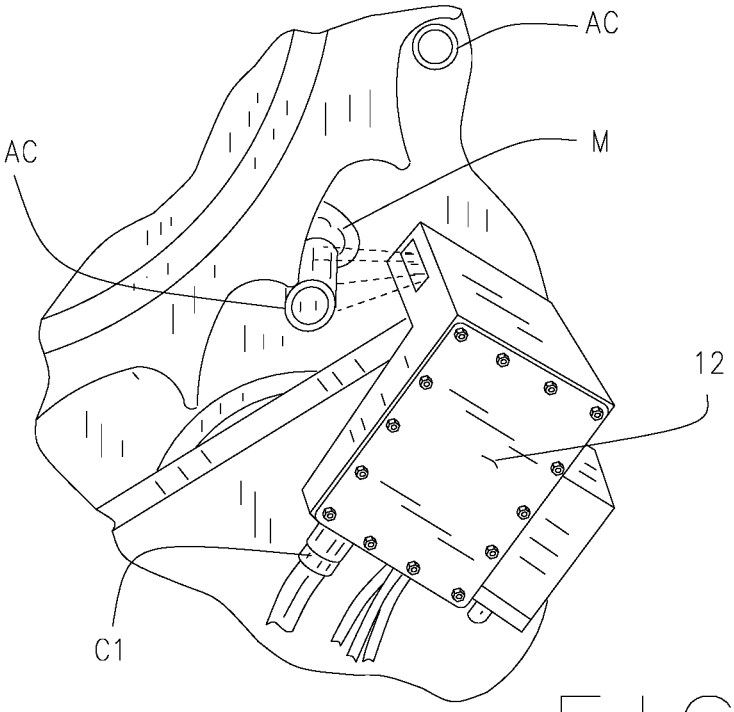

Referring to the drawings, it will be understood by those skilled in the art that aerosol containers AC, which can be of an aluminum or steel manufacture, are mounted on a mandrel M, see FIG. 12, which support them during their rotation through ink application and varnish application stages of a container printing process. During this printing portion of the manufacturing process each container is rotated more than three times within a 4" by 4" area as it proceeds through ink lay down and varnish application stations.

Figure 2:
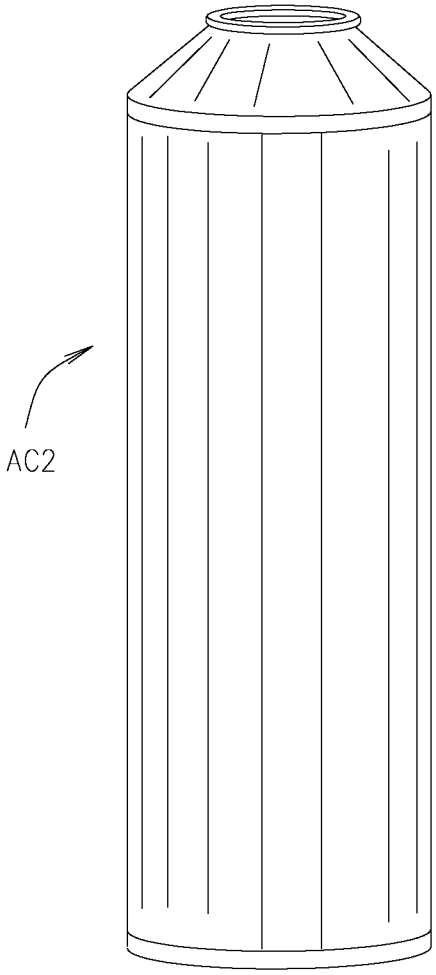
FIG. 2. illustrates a similarly printed container manufactured using an LED light source for curing the ink before a varnish is applied with no imperfections resulting on the exterior surface of the container.

As previously discussed with reference to FIG. 1, it was found that without using a light source at these stations to affect the ink curing unsightly results, as indicated by the portion of the outer surface of aerosol container AC1 within the lap line L shown on the container, often resulted. Accordingly, it was determined that a light source that effectively dried the ink was needed. Investigation into alternate light sources found that a low intensity light source employing LED lights rather than higher intensity Uv lights produced satisfactory results as indicated by the finished aerosol container AC2 shown in FIG. 2 which exhibits no lap lines, discolorations, or other imperfections. Again, this was accomplished without the problems associated with using high intensity Uv light sources.

In accordance with the invention, an LED module 12 is installed in the production line between the last location in the inking station where an ink is laid down on the container, and before the varnish station. Module 12 is available, for example, from Phoseon Technology Company of Hillsboro, Oregon. Further, those skilled in the art will understand that while one LED module is shown in the drawings, more than one module may be used in effecting the improvement of the present invention.

Figure 3:
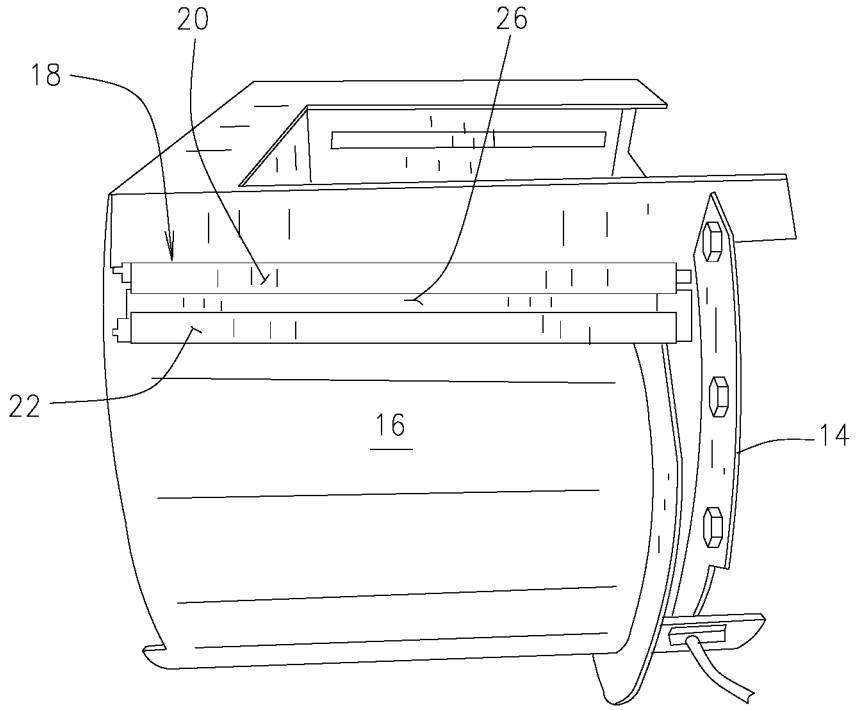
FIGS. 3 and 4 illustrate an LED light containment fixture to which a fitting is attached for installing an LED module for use in curing ink applied to the exterior of an aerosol container.
Figure 4:
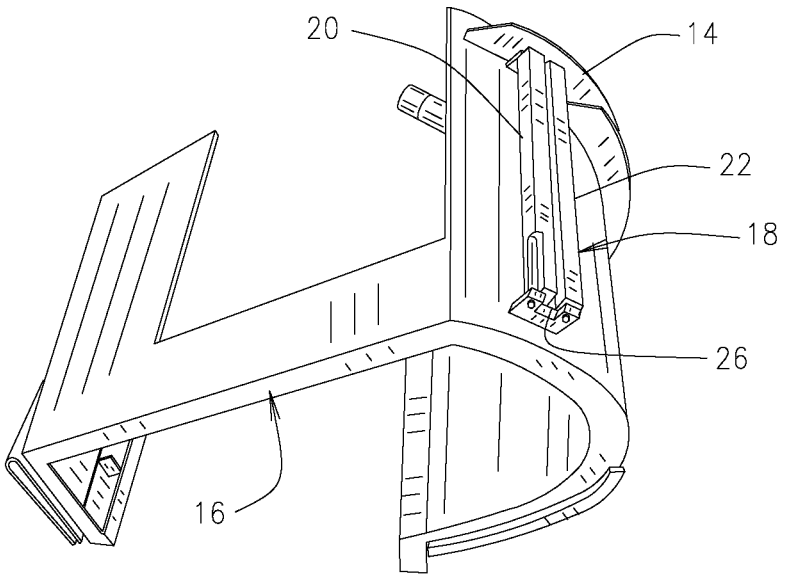

In the embodiment of the present invention, LED module 12 includes a plurality of LED lights arranged in a predetermined configuration;

To install an LED lighting module into the manufacturing line, and as shown in FIG. 3 and FIG. 4, a stainless-steel varnish guard 14 which fits about a varnish unit 16 through which aerosol containers AC are routed is removed and a mounting bracket indicated generally 18 for LED module 12 is installed on it. As shown in FIGS. 3 and 4, the mounting bracket comprises two plates 20, 22 extending parallel to each other and longitudinally of unit 16, the mounting bracket extending substantially the length of the unit. As also shown in FIGS. 3 and 4, plates 20, 22 are spaced apart so to form a slot 26 between them which also extends the length of mounting bracket 18.

Figure 5:
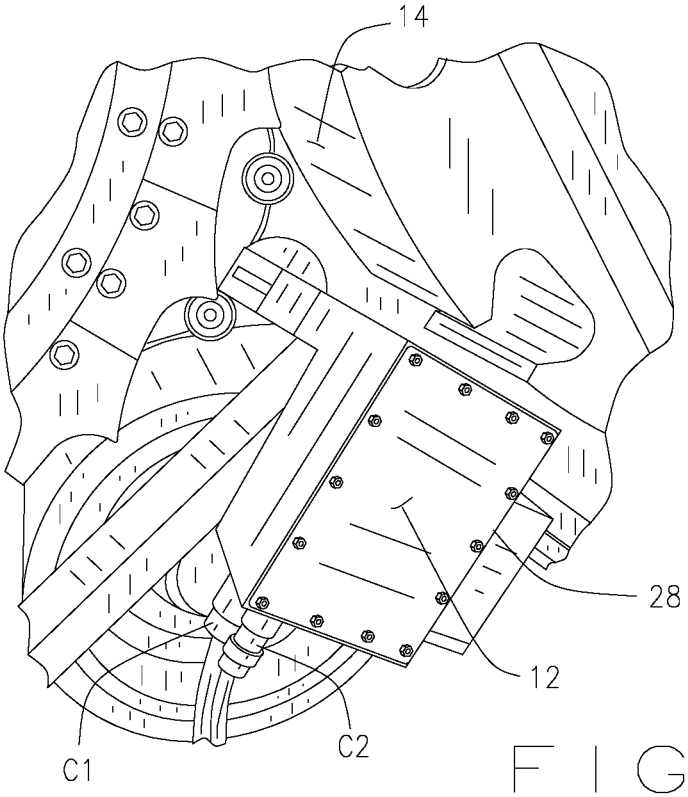
FIGS. 5 and 6 illustrate the mounting of the LED module to the housing for light from LED light sources installed in the module to be directed onto ink printed aerosol containers passing through a production line so to cure the ink before a varnish is applied to the container.
Figure 6:
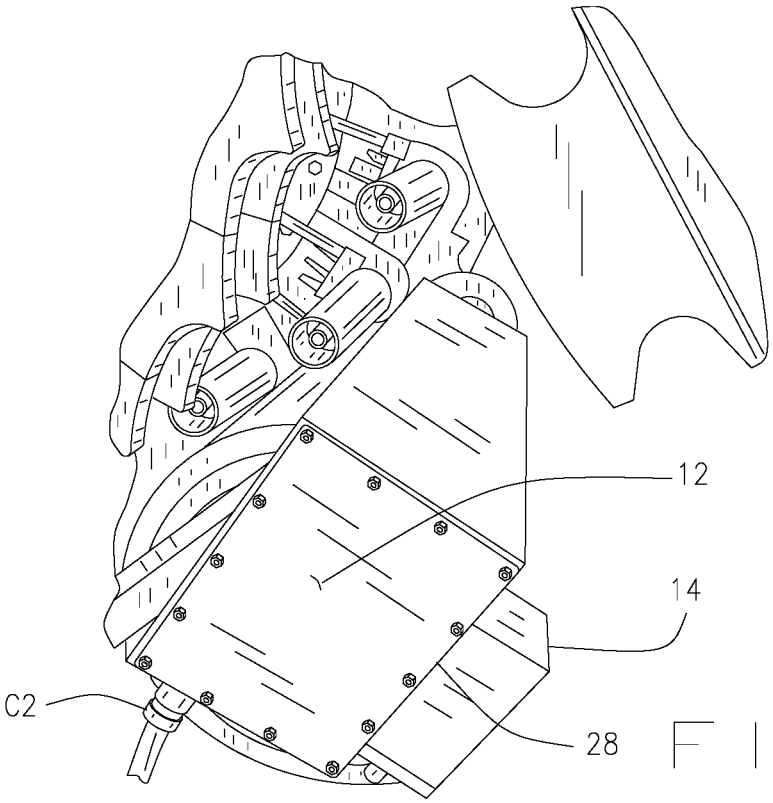

Next, as shown in FIGS. 5 and 6, LED module 12, which is an explosion proof containment module, is shown installed on varnish guard 14. As noted, LED module 12 contains a plurality of LED lights arranged in a predetermined configuration together with appropriate connectors C1, C2 for powering the unit and supplying control signals to it. As shown in the drawings, module 12 has a removable cover plate 28 for accessing the interior of the module to perform any maintenance or repairs.

Figure 7:
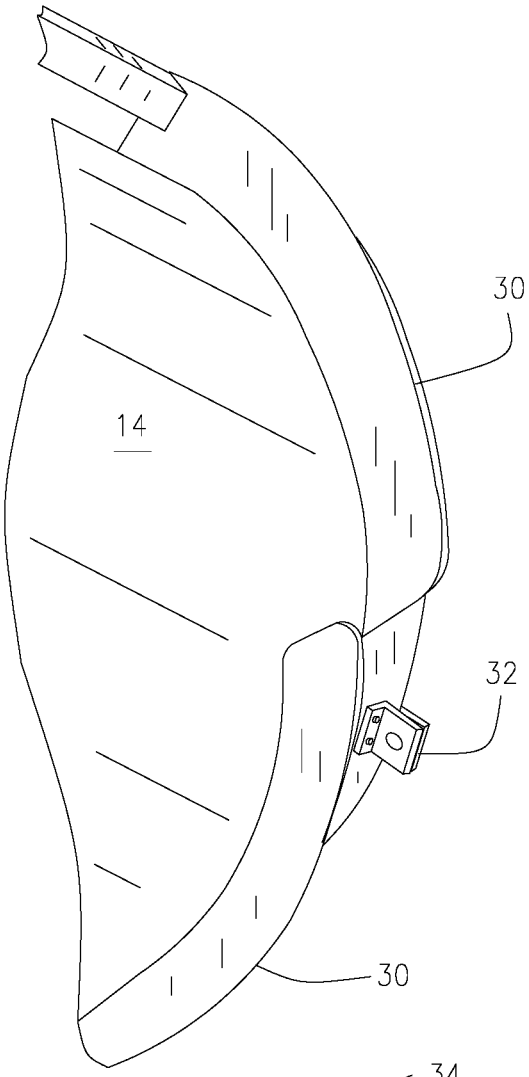
FIG. 7 illustrates a mounting support bracket installed on the LED light containment fixture, with portions of the bracket also being shown in FIG. 3 and FIG. 4.
Figure 8:
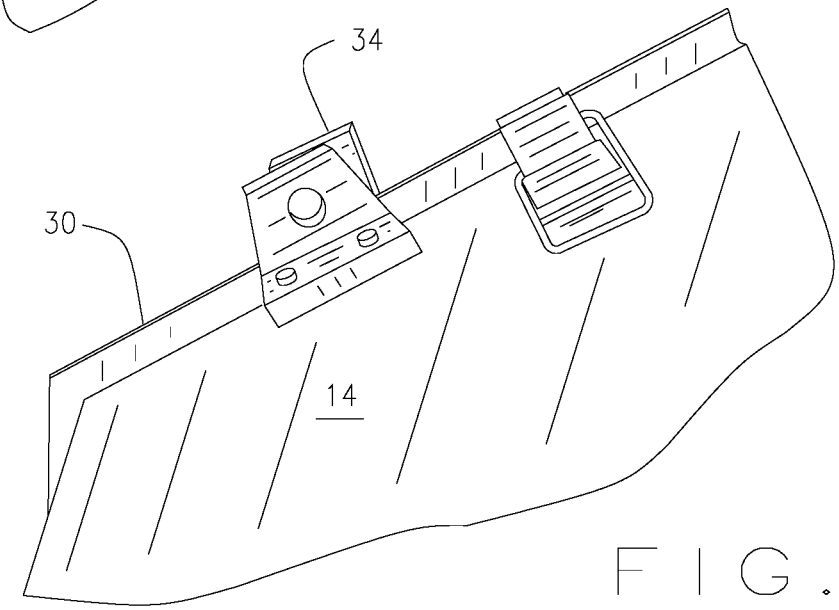
FIGS. 8 and 9 illustrate mounting brackets for installing the light containment fixture in place; and, FIGS. 10, 11, and 12 illustrate operation of the LEDs in the curing of aerosol containers.
Figure 9:
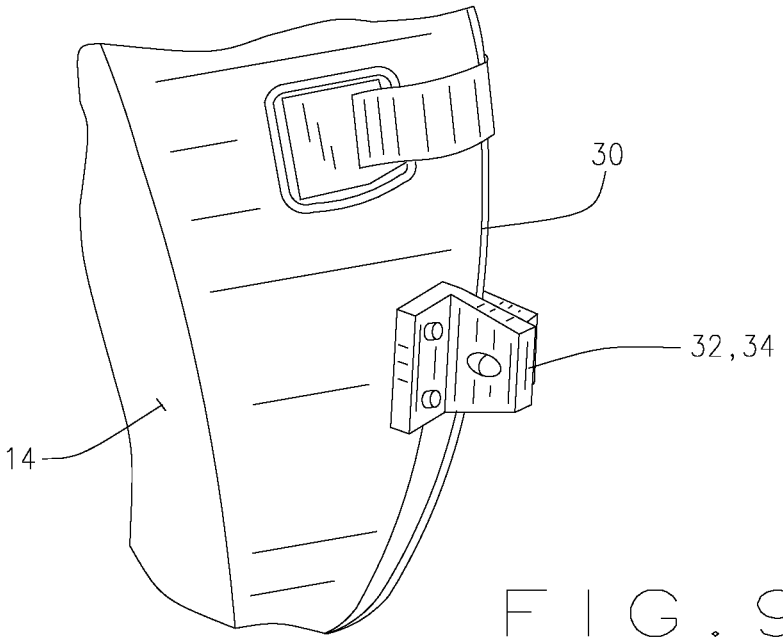

Referring to FIGS. 7, 8, and 9, LED module 12 is heavy. Accordingly, to install, support, and protect the module in place, a circular shaped mounting ring 30, extending substantially about the circumference of varnish guard 14, on the end of the guard facing the aerosol containers on the production line is fabricated and installed. In addition, mounting brackets 32, 34 are installed on mounting ring 30 for properly positioning LED module 12 and ensure that the LED light emitted by the module is properly focused on the passing aerosol containers and that module 12 remains in a stable position throughout the printing and curing process.

Figure 10:
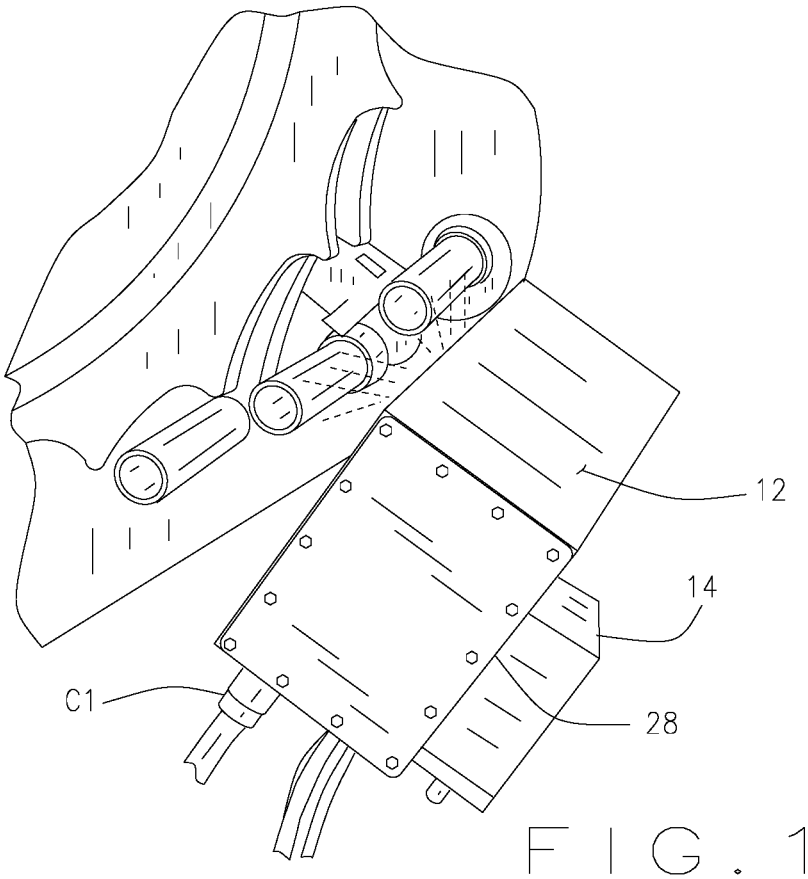
Figure 11:
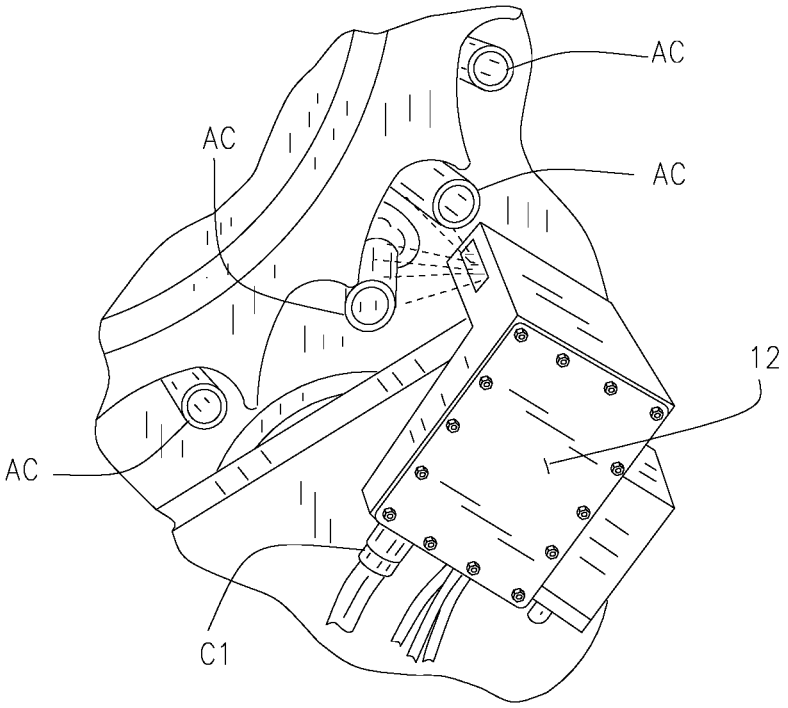

In operation, and as shown in FIGS. 10, 11, and 12, aerosol containers AC continuously move along a manufacturing or production line. As they proceed along the line, they first pass through a printing station where inks are laid down on the container in a predetermined pattern to form a desired design including both imagery and graphics. It will be understood by those skilled in the art that a number of different inks may be laid down on an aerosol container AC to create the imagery and graphics. Each color ink is laid down on a container at a different location within the printing station.

After the inks are laid down onto a container, they must first be dried before a varnish is applied which affixes the inks to the container. The respective FIGS. 10-12 illustrate operation of LED light module 12 in emitting light (as indicated by the dashed lines in the drawing figures, in a predetermined frequency range to effect this.

As part of the improved process, certain areas in, about, and adjacent to the inking and varnish stations are blacked out so that any light energy from LED module 12 impacting these areas is absorbed and not reflected back toward the containers.

The improved manufacturing process, as herein described, has the advantages of enabling the exterior surfaces of containers to be printed with solvent based varnishes now used for curing. Such containers demonstrate improved scratch and scuff resistance, a glossier appearance, no visible lap lines, and little or no yellowing. Again, the resulting improved production line performance allows container manufacturers to now provide a wider selection of container offerings.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

The invention claimed is:

1. An improved manufacturing process for production of aerosol containers whose exterior surface is printed with inks in a predetermined pattern to form a desired design including both imagery and graphics, the improved manufacturing process incorporating a dry offset printing process comprising:

an inking station and a varnish application station interposed in a container production line and through which aerosol containers successively pass, inks being applied to an aerosol container at the inking station and a varnish applied to the inked exterior of the container at the varnish station; and a LED light module installed between the stations to emit a light within a predetermined range of frequencies onto the inked container, the temperature associated with the LED light transmissions being at a cooler temperature than temperatures associated with Uv light sources which could be used for the same purpose whereby the exterior surface of the finished container exhibits no visible lap lines or discolorations and improved scratch resistance, lap lines and discolorations occurring when Uv light sources utilized in non-dry offset printing processes and operating at a higher temperature than that of the LED light module, such usage thereby causing printed aerosol containers to be rejected.

2. The improved manufacturing process of claim 1 further including installing a mounting bracket for the LED light module on a varnish guard which fits about a varnish unit through which aerosol containers are routed, the mounting bracket comprising two plates extending parallel to each other and longitudinally of the varnish unit substantially the length of the varnish unit.

3. The improved manufacturing process of claim 2 in which the plates are spaced apart from each other thereby to form a slot between them which extends the length of the mounting bracket.

4. The improved manufacturing process of claim 1 in which a mounting ring is installed on an end of a varnish guard facing the aerosol containers moving on the production line with spaced apart mounting brackets installed on the mounting ring for properly positioning the LED light module and ensuring that LED light emitted by the module is properly focused on the passing aerosol containers and that the LED light module remains in a stable position throughout a printing and curing process.

5. The improved manufacturing process of claim 1 wherein certain areas in, about, and adjacent to the inking station and varnish station are blacked out so that any light energy from the LED light module impacting these areas is absorbed and not reflected back toward the containers.

6. In a production line for aerosol containers whose exterior surface is printed with inks in a predetermined pattern to form a desired design including both imagery and graphics, the production line incorporating a dry offset printing process which includes an inking station and a varnish application station through which aerosol containers successively pass, inks being applied to an aerosol container at the inking station and a varnish applied to the inked exterior of the container at the varnish station, the improvement comprising:

a LED light module installed between the stations and emitting a light within a predetermined range of frequencies onto the inked container, the temperature associated with the LED light transmissions being at a cooler temperature than temperatures associated with Uv light sources employed in other, non-dry offset printing processes that could be used for the same purpose whereby the exterior surface of the finished container exhibits no visible lap lines or discolorations and has improved scratch resistance, lap lines and discolorations occurring when Uv light sources utilized in non-dry offset printing processes and operating at a higher temperature than that of the LED light module, such usage thereby causing printed aerosol containers to be rejected.

7. The improvement of claim 6 further including a mounting bracket for the LED light module which is installed on a varnish guard that fits about a varnish unit through which aerosol containers are routed, the mounting bracket comprising two plates extending parallel to each other and longitudinally of the varnish unit substantially the length of the varnish unit.

8. The improvement of claim 7 in which the plates are spaced apart from each other thereby to form a slot between them which extends the length of the mounting bracket.

9. The improvement of claim 6 further including a mounting ring is installed on an end of a varnish guard facing the aerosol containers moving on the production line, and spaced apart mounting brackets installed on the mounting ring for properly positioning the LED light module and ensuring that LED light emitted by the module is properly focused on the passing aerosol containers and that the LED light module remains in a stable position throughout a printing and curing process.

10. The improvement of claim 6 further including blacking out certain areas in, about, and adjacent to the inking station and varnish station so that any light energy from the LED light module impacting these areas is absorbed and not reflected back toward the containers.

* * * * *